US005466060A

United States Patent [19]

Hoffman

[11] Patent Number: 5,466,060

[45] Date of Patent: Nov. 14, 1995

[54] DRAWER SLIDE WITH ACCESS HOLES

[75] Inventor: Keith A. Hoffman, Hudsonville, Mich.

[73] Assignee: Knape & Vogt Manufacturing Company, Grand Rapids, Mich.

[21] Appl. No.: 109,739

[22] Filed: Aug. 20, 1993

Related U.S. Application Data

[63] Continuation-in-part of Ser. No. 934,423, Aug. 24, 1992, Pat. No. 5,316,389, and a continuation-in-part of Ser. No. 932,718, Aug. 20, 1992, abandoned.

[51] Int. Cl.[6] ..... A47B 88/00

[52] U.S. Cl. ..... 312/334.8; 312/334.5; 312/334.11; 312/334.44

[58] Field of Search ..... 312/334.8, 334.5, 312/334.11, 334.1, 334.44, 334.7, 334.17

[56] References Cited

U.S. PATENT DOCUMENTS

| | | | |
|---|---|---|---|
| 1,071,006 | 8/1913 | Little | 312/334.8 X |
| 2,277,702 | 3/1942 | Kennedy | 45/77 |
| 2,277,703 | 3/1942 | Kennedy | 45/77 |
| 2,859,070 | 11/1958 | Gomersall | 308/3.8 |
| 2,981,584 | 4/1961 | Friend | 312/337 |
| 3,092,429 | 6/1963 | Barnes | 312/333 |
| 3,123,419 | 3/1964 | Maxwell | 312/333 |
| 3,141,714 | 7/1964 | Valitus | 312/348 |
| 3,142,517 | 7/1964 | Ward | 308/3.6 |
| 3,243,247 | 3/1966 | Knape | 312/333 |
| 3,259,447 | 7/1966 | Deutsch | 312/348 |
| 3,278,250 | 10/1966 | Vogt | 312/339 |
| 3,298,768 | 1/1967 | Vogt | 312/334.44 X |
| 3,589,778 | 6/1971 | Olson | 308/3.6 |
| 3,782,800 | 1/1974 | Remington | 312/333 |
| 3,801,166 | 4/1974 | York | 312/334.44 X |
| 3,937,531 | 2/1976 | Hagen | 308/3.8 |
| 3,954,315 | 5/1976 | Sanden | 312/333 |
| 3,995,927 | 12/1976 | Stein | 312/333 |
| 4,065,196 | 12/1977 | Stein | 312/333 |
| 4,274,689 | 6/1981 | VanderLey | 312/333 |
| 4,291,929 | 9/1981 | Faust | 312/334.17 X |
| 4,423,914 | 1/1984 | VanderLey | 312/333 |
| 4,441,772 | 4/1984 | Fielding | 312/330 |
| 4,469,384 | 9/1984 | Fler et al. | 312/334.11 X |
| 4,473,262 | 9/1984 | Staye | 312/333 |
| 4,480,878 | 11/1984 | Leiper | 308/3.8 |
| 4,560,212 | 12/1985 | Papp | 308/3.8 |
| 4,662,761 | 5/1987 | Hoffman | 384/18 |
| 4,749,242 | 6/1988 | Rechberg | 312/334.11 X |
| 4,765,669 | 8/1988 | Bessinger | 312/339 |

FOREIGN PATENT DOCUMENTS

| | | | |
|---|---|---|---|
| 2721231 | 11/1978 | Germany | 312/334.11 |
| 4096711 | 3/1992 | Japan | 312/334.1 |

*Primary Examiner*—James R. Brittain
*Assistant Examiner*—Janet M. Wilkens

[57] ABSTRACT

A drawer slide assembly of telescopically interfit drawer, cabinet and center channels, the drawer and cabinet channels including screw mounting orifices, and the center channel having an enlarged access opening positioned to be in alignment with those orifices. A bearing retainer is engageable by a polymeric engaging member on the center channel.

16 Claims, 7 Drawing Sheets

28
122
32
52k
30
16
62
122
60e
60d
52j
52i
52h
52g
52f
52e
26
50k
120
120
48
48
170
24
60c
14
25
50j
50i
50h
23
54
60b
48
69
44
46
50g
50f
50e
50d
52d
52c
52b
52d
48
60a
42
40
12
10
14
12
22
64
20
16
64

48
50c
50a
36
50b
38
34

DRAWER SLIDE WITH ACCESS HOLES

CROSS-REFERENCE TO RELATED APPLICATION

This application is a continuation-in-part of U.S. application Ser. No. 934,423, filed Aug. 24, 1992, now U.S. Pat. No. 5,316,389, entitled DRAWER SLIDE ASSEMBLY, by Keith A. Hoffman; and U.S. patent application Ser. No. 07/932,718, entitled PRECISION DRAWER SLIDE MEMBER, by Keith A. Hoffman, the disclosures of which are incorporated herein by reference.

FIELD OF THE INVENTION

The present invention relates to drawer slides. More specifically, the present invention relates to precision drawer slides for use in residential and office furniture.

BACKGROUND OF THE INVENTION

Generally, drawer slides are channel-shaped members comprising two or more channel sections installed within cabinetry of various kinds, and which have the capability of guiding drawers and drawer-like constructions within the cabinet space. As can be appreciated, movement of the drawer slide is desired to be fairly effortless when traversing between a closed position and an open position. It is also typically a function of drawer slides to allow the drawer or drawer-like construction to open far enough to gain substantially complete or full access to the contents therein.

In the industry there has arisen a terminology relating to "precision" drawer slides. Generally speaking, precision drawer slides are directed toward applications where the load capacity of the drawer slides is considered to be fairly significant. The loading considerations may start in the range of 75 to 100 pounds and may exceed 200 pounds at the upper end. This terminology, however, encompasses a great many different slide designs and should not be viewed as limiting, either in terms of the design of the particular slide, or the application to which it is put.

One particular type of drawer slide design is a telescoping precision slide. In this particular design, two or more channel members operate in a telescoping fashion such that the smallest member extends to the most outward position. Many different precision drawer slides are made utilizing this general design concept, and it should be noted that they cover a wide variety of applications and load capacities.

The general method by which the precision drawer slides are mounted includes fastening the larger, or outer, member to the cabinet structure, and separating from the slide assembly a member that is independently mounted on the drawer sidewalls. The most common precision slide of this type includes a third, or center, member which typically remains engaged with the mounted cabinet member. It is possible after such mounting of both the cabinet assembly and the drawer member to reengage the two back together. Since the same steps are taken on the opposite side of the drawer and cabinet structure, a drawer and cabinet in the preinstalled state just described may be completely engaged with the precision slide.

Since the drawer slides of the present invention are mainly directed toward furniture constructed from wood, the "fit" of the drawer within the cabinet is usually subject to correction before the installation process is completed. The need for correction is immediately apparent when the drawer is closed and a visual inspection results in the determination that the drawer front does not fit square or plumb within the cabinet structure. At this point in time, the prior art would require that the drawer be opened and the drawer portion of the precision slide be disengaged from the cabinet portion and the drawer totally removed from the cabinet. Then it is possible to adjust the mounting position of the drawer portion of the precision slide by loosening or removing the screws holding the member to the drawer sidewall and making the appropriate directional adjustment. Reinstallation of the drawer follows the previously described procedure. This process is repeated until such time as a good fit is established.

However, there has been a longstanding need in the industry to provide for a quick and efficient method of adjustment to accomplish drawer fit. Removal of the drawer from the cabinet is a time consuming step, especially when the trial and error approach must be utilized several times before achieving a good result.

There have been attempts to improve the installation process of precision slides, the most notable being a slide of the progression type. As compared to a telescoping drawer slide, the progression design has an upper channel member and a lower channel member interconnected by a slidable plate. This "over and under" design stacks the channels vertically within the space between the cabinet structure and the sidewall of the drawer. Versions of this product are known which include through holes, or access holes, in the channel members so that access to the mounting screws holding the drawer to the drawer member is obtained. Thus, adjustment of this type of drawer slide is possible when the drawer is moved to the fully open position. At this point, the screws can be loosened, the drawer adjusted, the screws then retightened, and the drawer closed, to check fit. The process is repeated until a suitable fit is achieved and the screws are thereafter tightened down.

Prior to the present invention, access holes in a telescoping drawer slide which would allow adjustment of the drawer in the installed condition were totally unknown. The reason for this lies in part to the increased complexity involved in horizontal alignment of the various components of a telescoping drawer slide. As compared to the over and under progression type of drawer slide, there may be two or more components of the slide mechanism, such as ball retainers, center channels and the like, impeding access to the mounting screws.

In the prior art, during installation of the cabinet portion of the drawer slide to the cabinet structure, it is necessary to move the component elements of the cabinet portion so as to achieve access for each particular mounting hole. Thus, it may require moving a center channel and ball retainer into different locations. The typical precision drawer slide is mounted by screwing the cabinet member to the cabinet sidewall of a drawer, and the two can be slidably reengaged. After engagement, the drawer may be moved from an open position to a closed position and the need for any adjustments is determined. Any subsequent adjusting of the drawer requires only that the drawer be extended to the open position sufficient to expose the mounting screws in the drawer member by means of access ways compatibly disposed about the center channel. The adjustment can take place by loosening the mounting screws, as required, and the foregoing steps repeated until the desired fit is obtained.

In addition, a drawer slide and/or method for installing a drawer using a slide of the type described herein further comprises the additional step of mounting a cabinet assembly with a cabinet channel and a center channel in slidable relation, into a cabinet structure where the inner ball retainer assembly is held in a latched position so that access ways are in alignment. The access ways therefore enhance installation of the cabinet portion of the drawer slide by facilitating straightforward and direct mounting of the cabinet member to the cabinet structure.

It is an object of the present invention to provide for a drawer slide which reduces the time and effort involved in installation of a drawer in a cabinet. It is a further object of the present invention to provide a method for installing a drawer in a cabinet utilizing a slide of the-type described herein. These and other objects of the present invention will become apparent as the details of the invention are disclosed below.

BRIEF DESCRIPTION OF THE DRAWINGS

Various embodiments of the invention are illustrated in the drawings.

DETAILED DESCRIPTION OF THE PREFERRED EMBODIMENTS

A detailed description of a drawer slide 10 is found in U.S. Pat. No. 5,316,389 and patent application Ser. No. 07/932,718 incorporated hereinabove by reference thereto. However, a general description of portions of the drawer slide is provided hereinbelow.

Figures 1, 2:
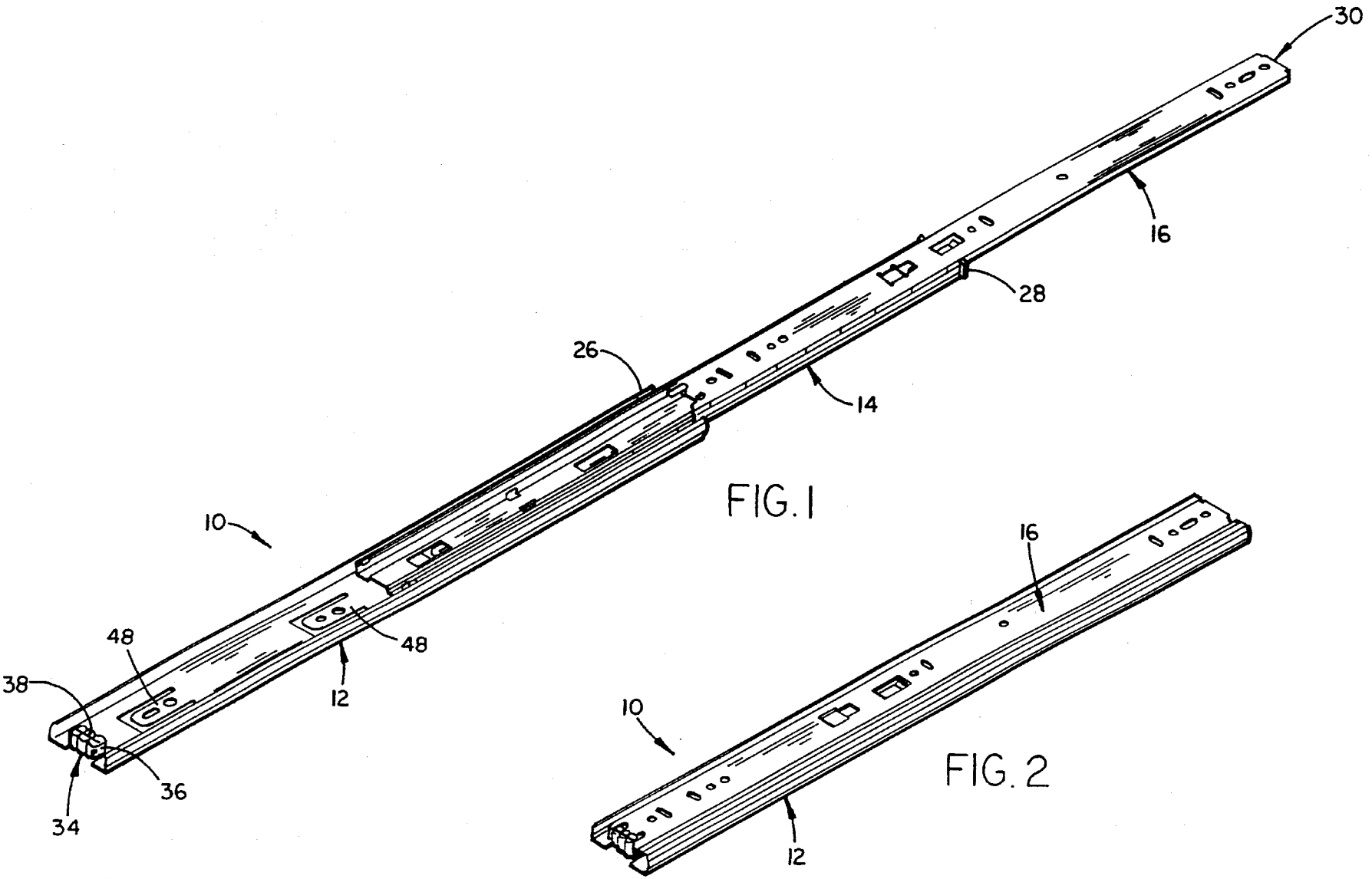
FIG. 1 shows a perspective view of a telescoping drawer slide in the open position.
FIG. 2 shows a perspective drawing of a telescoping drawer slide in the closed position.

A drawer slide and a method for installation of a drawer in a cabinet utilizing the drawer slide 10 of the present invention is described herein. The drawer slide 10 is generally of a telescoping design. More specifically, as shown in FIG. 1, drawer slide 10 includes cabinet channel 12, center channel 14 and drawer channel 16. As can be seen in FIGS. 1 and 2, the interrelation of the three channels is such that the drawer channel nests in the center channel, which center channel nests in the cabinet channel to form a telescopic structure.

Figure 3A:
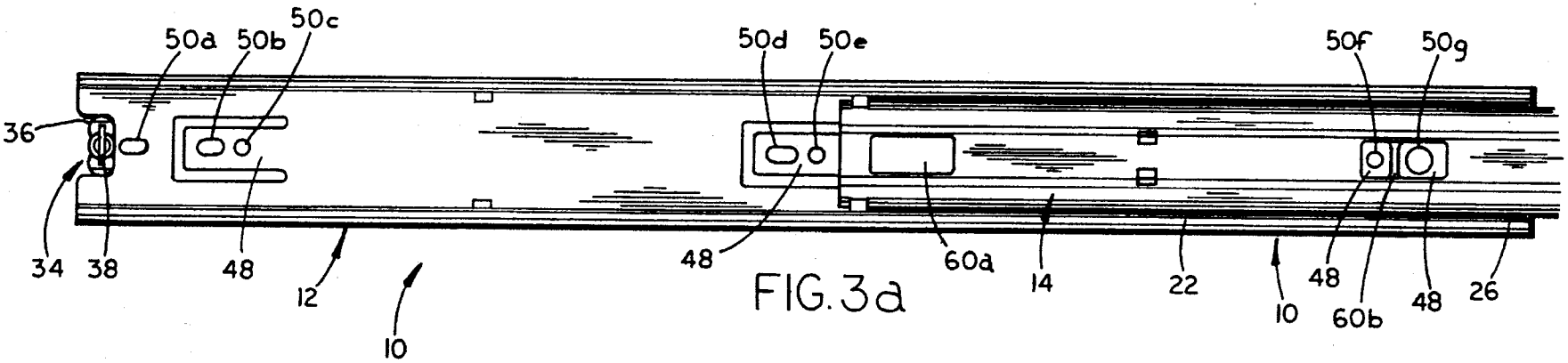
FIGS. 3*a* and 3*b* are side elevational views of a telescoping drawer slide in the open position.
Figure 3B:
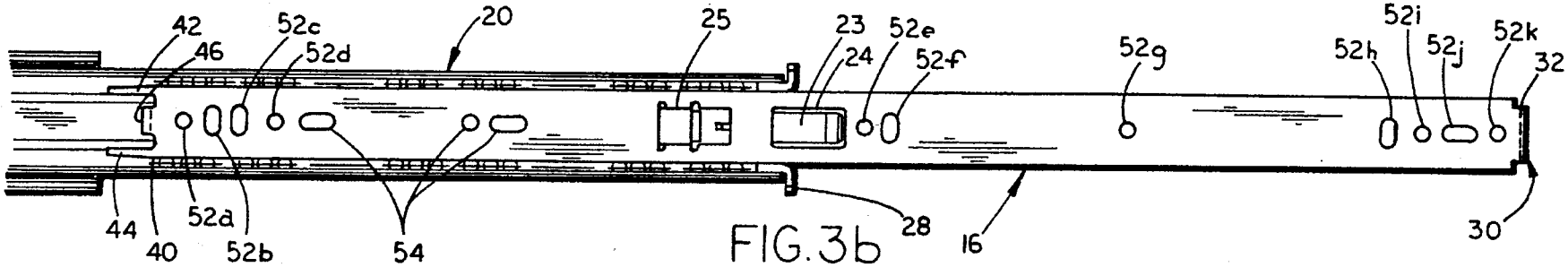
Figure 4:
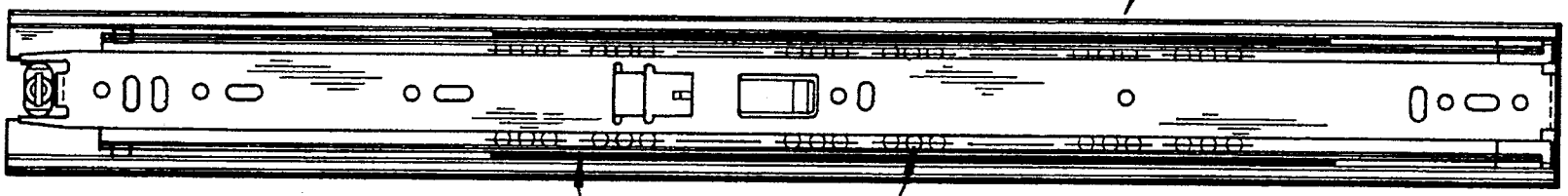
FIG. 4 is a side elevational view of a telescoping drawer slide in the closed position.
Figures 5, 6:
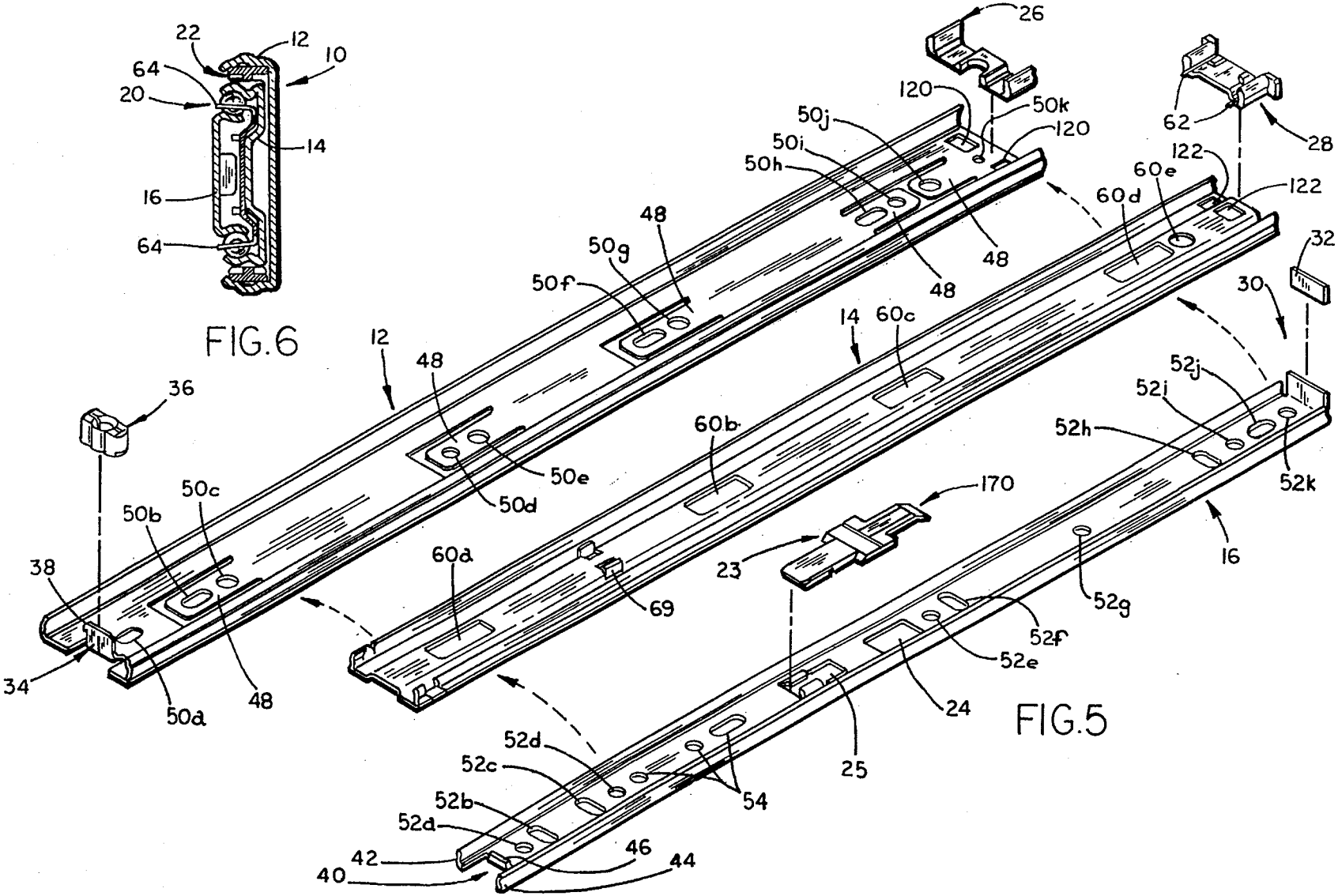
FIG. 5 is an exploded perspective view of the drawer slide components.
FIG. 6 is a cross sectional view of the cabinet portion of a drawer slide.

Turning now to FIGS. 3–5, the drawer slide 10 of the present invention is shown with the cabinet channel 12, the center channel 14 and the drawer channel 16 in both the open and closed positions, respectively. As shown in FIGS. 3 and 6, it is also shown as further comprising inner ball retainer assembly 20, outer ball retainer assembly 22, stop lever 23, with associated stop lever access hole 24 and stop lever mounting hole 25. The drawer slide 10 also includes a cabinet stop 26, center stop 28, and a drawer stop 30. The drawer stop includes a drawer stop cushion 32. Also located at the extreme rearward end of the drawer slide is end stop 34 which is located on the cabinet channel 12. The end stop includes an end stop cushion 36 and the end stop tab 38.

Located near the midpoint of the drawer slide assembly in FIG. 3, and shown in FIG. 5, is the drawer channel end 40. The drawer channel end 40 is located near the rearward end of the drawer channel 16 itself. End 40 comprises the drawer channel end member top 42 and the drawer channel end member bottom 44. End 40 also includes the drawer channel end tab 46.

Disposed about the cabinet channel member 12 are the cabinet mounting hole tabs 48 (FIG. 5) and the cabinet member mounting holes 50(*a*) through 50(*i*). The drawer member 16 includes drawer member mounting holes 52(*a*) through 52(*k*). There are additional mourning holes located on the drawer member and noted as ancillary drawer member mourning holes 54. These are given different nomenclature for the reason that they do not specifically comprise a part of the present invention, although they are provided commercially with drawer slides of this type for the benefit of certain customers who require the same. The center channel member 14 includes access ways 60(*a*) through 60(*e*).

FIG. 6 shows a cross section of the drawer slide assembly 10. The stackup of the drawer channel, center channel and cabinet channel which have been described can be seen. Also shown are the bearing retainer assemblies 20 and 22, and the manner in which the components nest together. As shown, bearing retainer assembly 20 forms a connector between center channel member 14 and nested drawer channel 16. Bearing retainer assembly 22 forms a connector between cabinet channel member 12 and nested center channel 14.

Figure 7A:
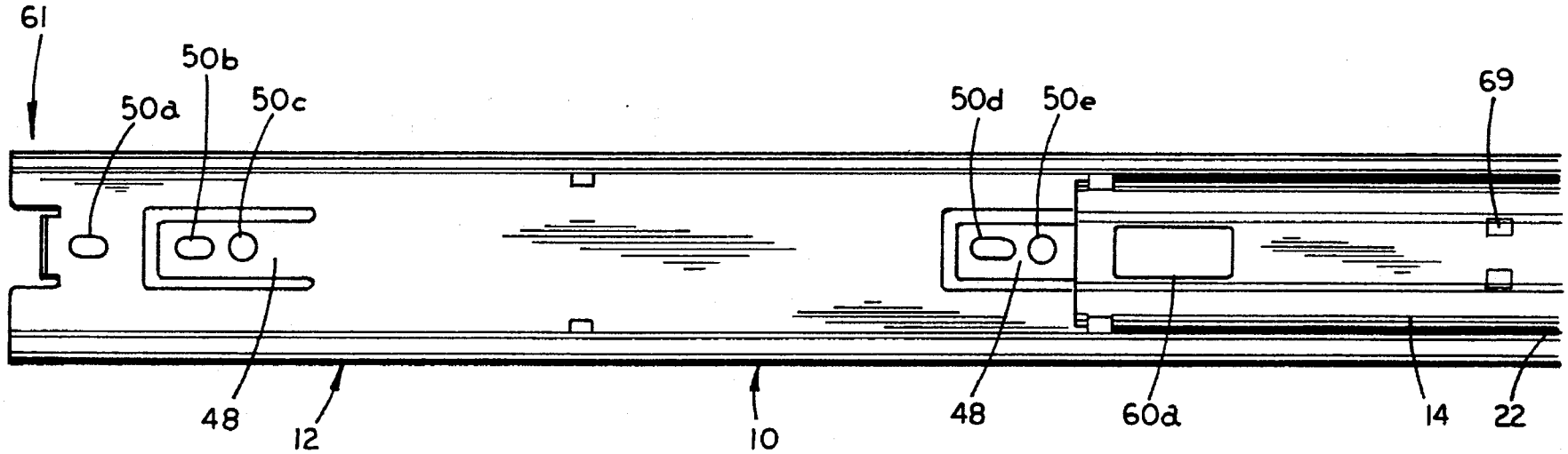
FIGS. 7*a* and 7*b* are side elevational views of a cabinet portion of a drawer slide of the present invention in the open position.
Figure 7B:
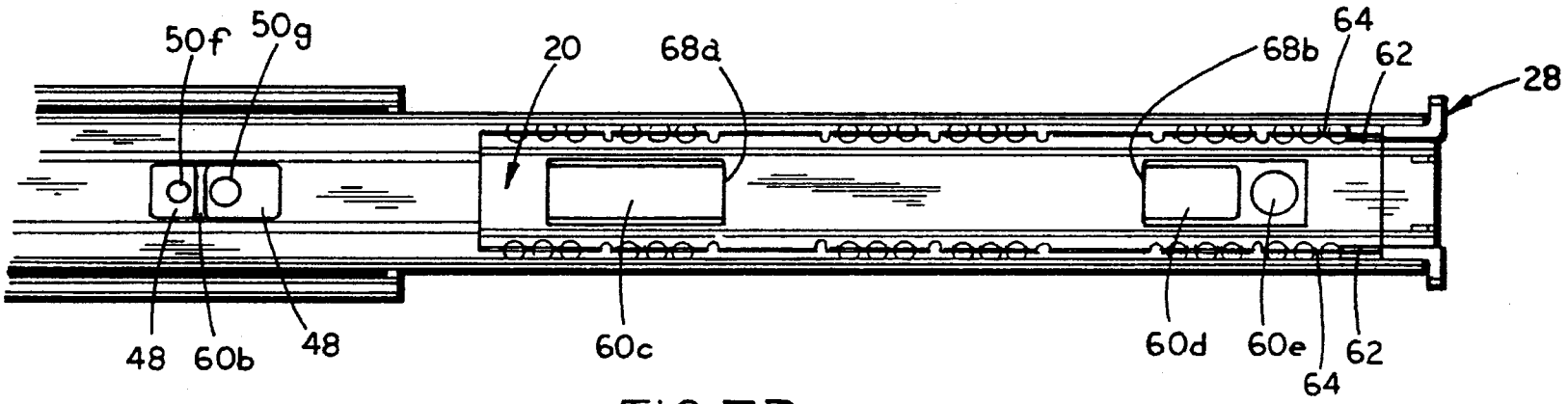
Figure 8B:
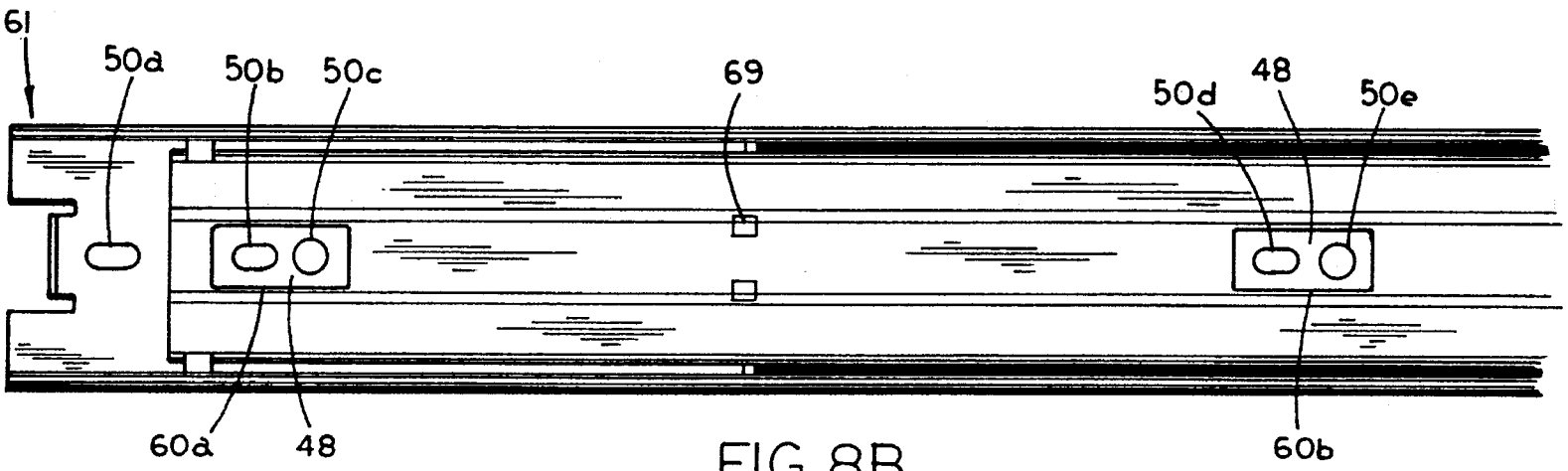
FIGS. 8*a* and 8*b* are side elevational views of a cabinet portion of a drawer slide of the present invention in the closed position.
Figure 8A:
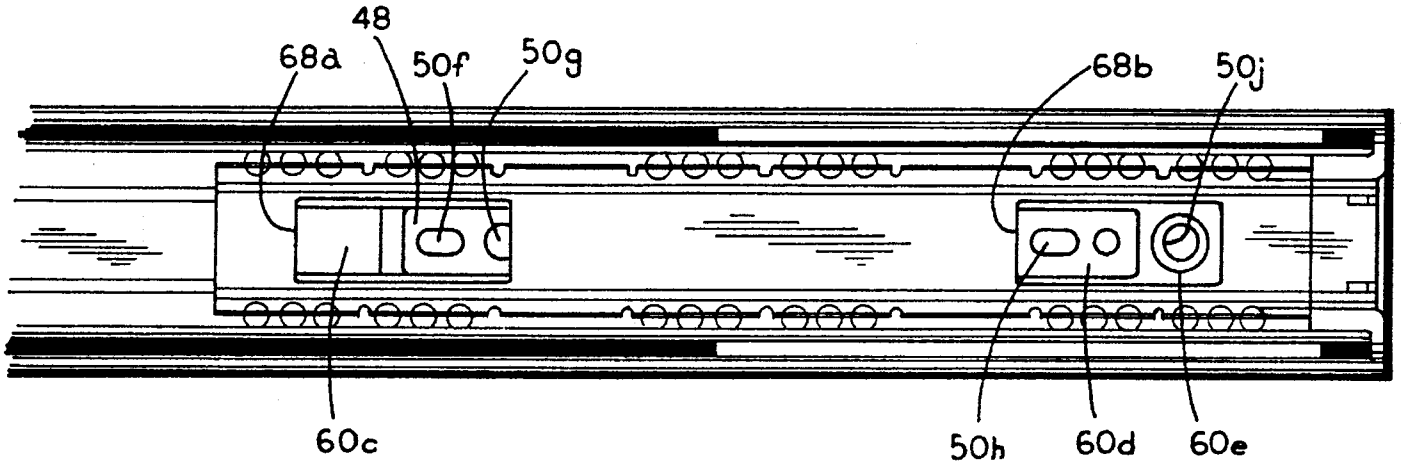

FIGS. 7 and 8 are related in the sense that they disclose a cabinet portion 61 of the present invention, in both the open and closed positions. Commencing with the description of FIG. 7, and in addition to the previously described features, the center channel stop 28 includes the latch grips 62, both top and bottom. Latch grips 62 located on the inner end of center stop 28 are a pair of specially tapered, resilient, projecting fingers (FIGS. 5, 7*b*) integral with the center stop, spaced from and parallel to each other, and spaced from the outermost plane of center stop 28 to overlap the metallic inner ball retainer in a position of the retainer adjacent the center stop. In close relation thereto the inner ball retainer assembly includes the flange end 64, both top and bottom.

The inner ball retainer also includes the inner ball retainer access ways 68(*a*) and 68(*b*).

The inner end of center stop element 28 also serves to limit actual movement of the outer axial end of the inner ball retainer assembly 20. The inner axial end of movement of the inner ball retainer assembly 20 is limited by the collector or collectors tabs 69 (FIG. 1, 5). These collectors 69 are specially located relative to the outer end of the center channel such that optimum positioning of the channel members occurs with respect to each other. That is, these inner collector tabs are so located so that inner bail retainer 20 does not strike center stop 28 at full extension, under normal conditions. Because the inner ball retainer moves at one-half the speed and one-half the distance of the center channel when extended, with proper placement of collector tabs 69, that is, greater than the length of inner ball retainer 20 plus one-half of the travel distance of drawer channel 16 relative to center channel 14, the inner ball retainer assembly 20 will not normally strike but will stop closely adjacent to but short of center stop 28. If, however, stop lever 23 is actuated to withdraw drawer channel 16 from drawer slide 10, movement of inner ball retainer assembly 20 will be restrained by center stop 28.

Figure 9:
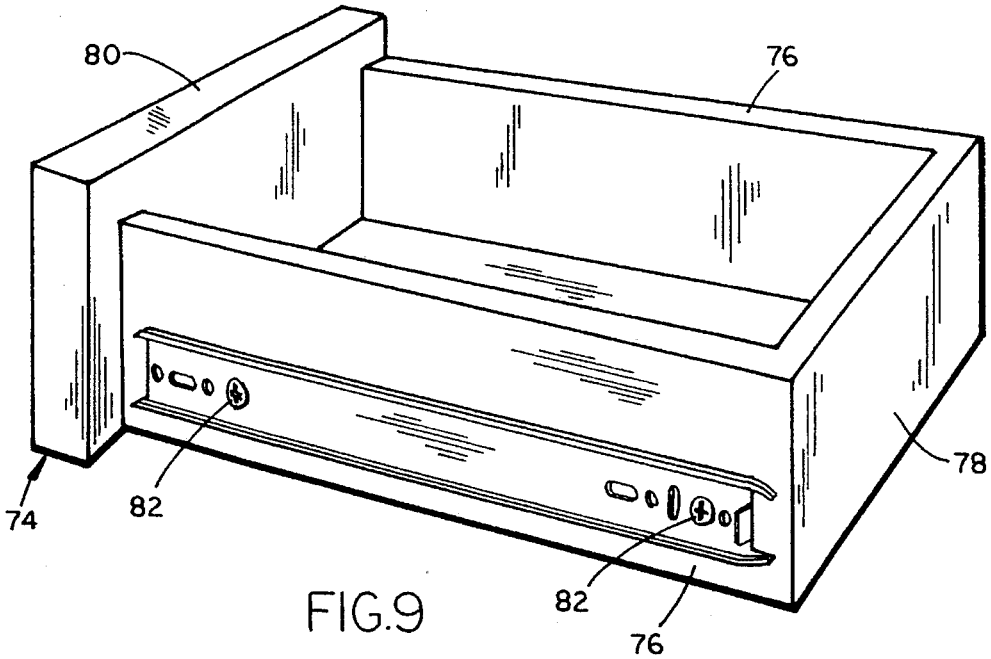
FIG. 9 is a side perspective view of a drawer member portion of a drawer slide of the present invention in the installed condition on a drawer.

Turning now to FIG. 9, a typical drawer box 74 includes sides 76, back 78, and from 80. Mounted to a side 76 is a drawer channel 16 of the drawer slide 10. Channel 16 is affixed to side 76 by means of screws 82, and comprises the drawer portion 79 of the illustrated embodiment.

Figure 10:
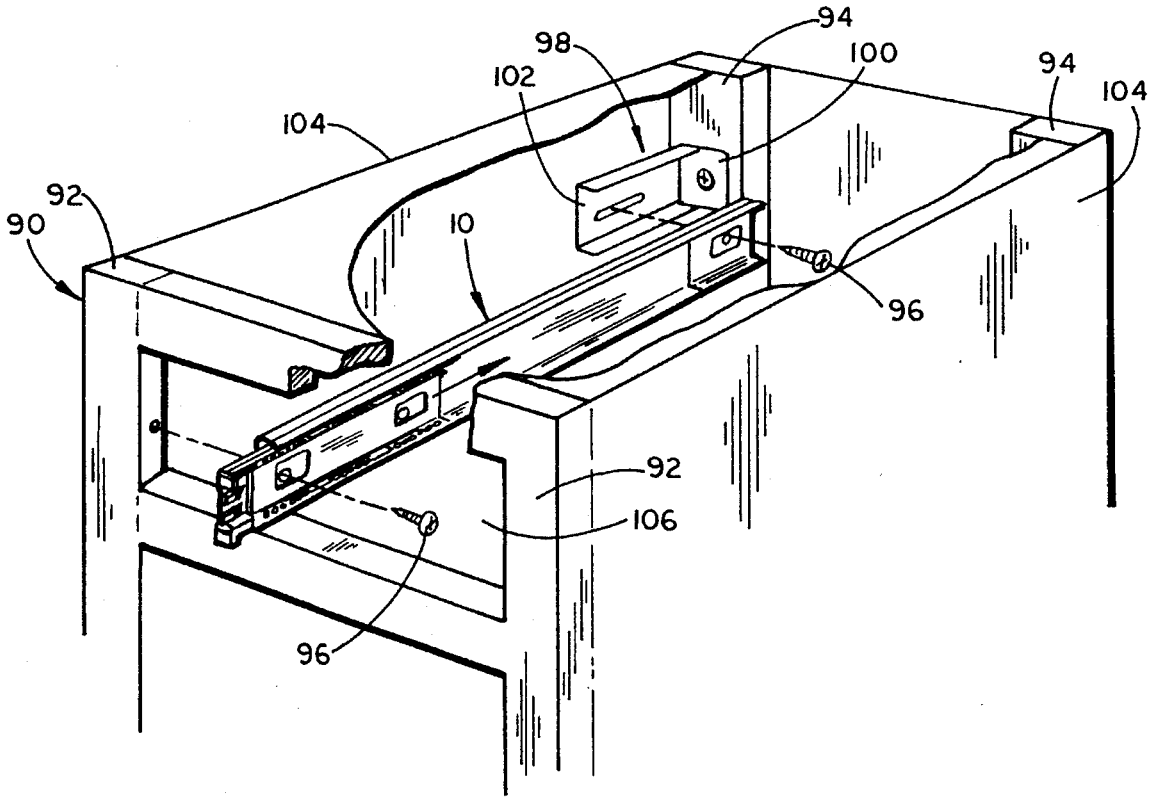
FIG. 10 is a perspective view of a cabinet portion of a drawer slide of the present invention mounted in a frame type cabinet.

A frame cabinet 90 (FIG. 10) includes a from cabinet post 92 and rear cabinet post 94. The cabinet also includes cabinet sides 104 and drawer opening 106. Shown in this figure are the cabinet drawer channel 12 and center channel 14 of drawer slide 10 in a position ready to be installed. The drawer channel and center channel comprise the channel portion of the drawer slide assembly 10 in the illustrated embodiment. As part of the installation, a slide mount 98 is shown mounted to the rear of the cabinet structure by means of fastening slide mount back 100 to the rear cabinet post 94 and the extension of slide mount side 102 therefrom in horizontal relation to the cabinet portion of the drawer slide. Screws 96 are shown in ready alignment for completion of the installation as indicated.

Figure 11:
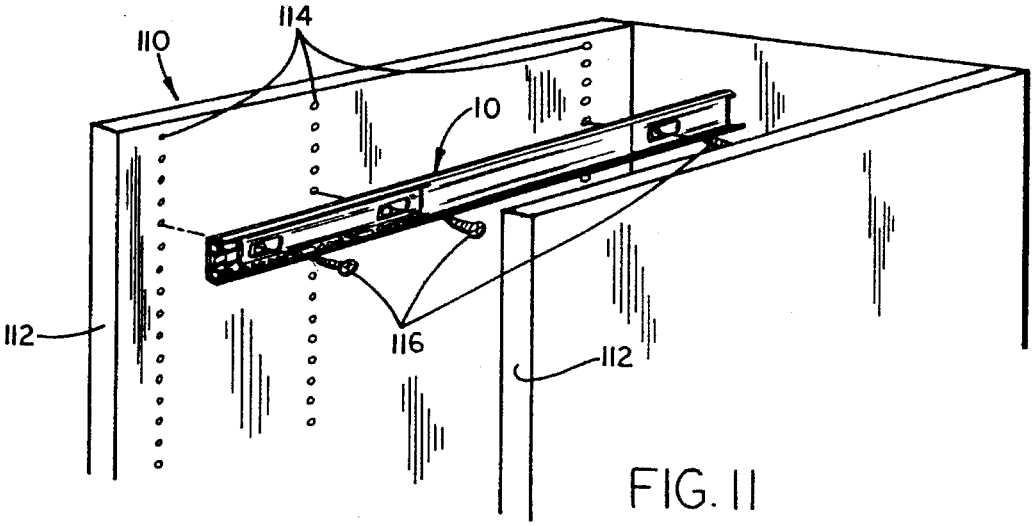
FIG. 11 is a perspective view of a cabinet portion of a drawer slide of the present invention mounted in a frameless cabinet.

A frameless cabinet 110 is shown in FIG. 11, and includes sidewalls 112 and mounting holes 114. The cabinet portion 61 of a drawer slide 10 of the present invention in a preinstalled orientation. The cabinet portion 61 is shown in proximity to its mounting points which comprise the mounting holes 114 and sidewalls of the frameless cabinet. Completion of installation includes insertion of the screws 116 through the cabinet portion and into the sidewalls themselves.

Figure 12:
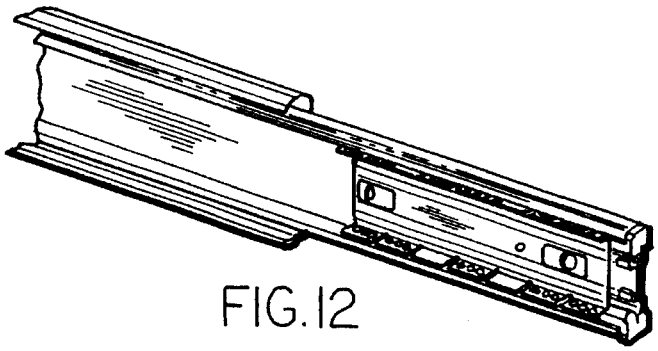
FIG. 12 is a perspective view of a cabinet portion of a drawer slide of the present invention with the inner ball retainer shown in the latched position.
Figure 13:
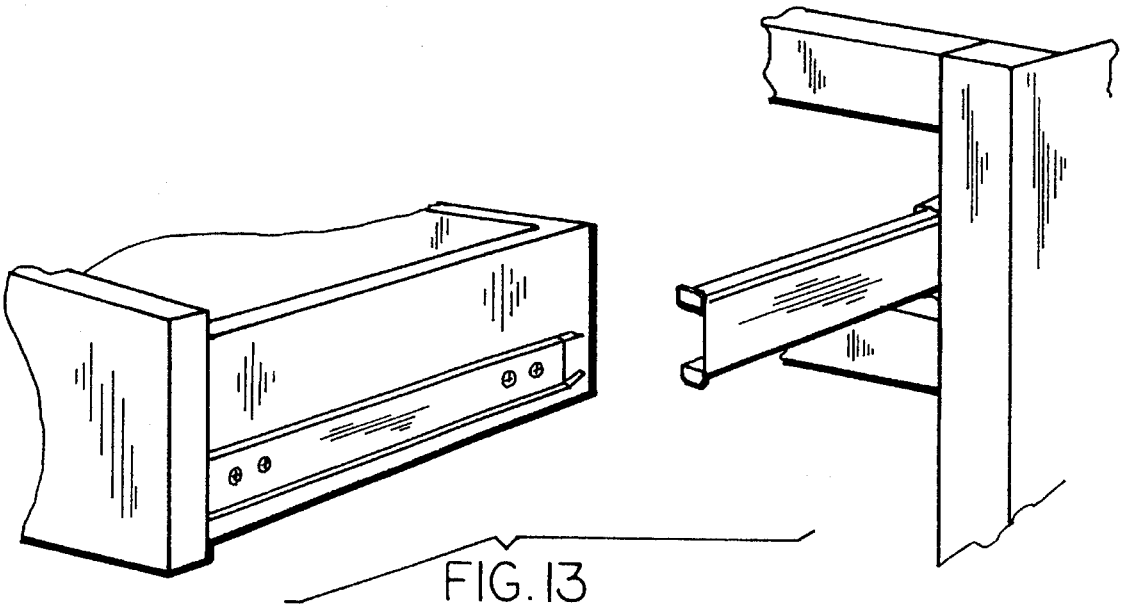
FIG. 13 is a perspective view of a drawer with a drawer portion of a drawer slide of the present invention mounted thereon, and a cabinet with a cabinet portion of a drawer slide of the present invention mounted thereon at the commencement state of installation of the drawer into the cabinet.

Turning now to FIGS. 12 and 13, the process of installing a drawer slide of the present invention will be described. The inner ball retainer assembly 20 shown in FIG. 12 is moved to the latched position where it is held by the latch grips 62 which exerts a small amount of tension on the flange ends 64 of the inner ball retainer.

FIG. 13 similarly discloses the orientation of the drawer box 74 with respect to the cabinet 90 and the center channel 14 of cabinet member portion of the drawer slide 10. The arrow within FIG. 13 being the direction of insertion of the drawer member into the corresponding features of the cabinet portion of the drawer slide.

The drawer slide assembly 10 of the present invention is installed according to the construction type of the cabinet. In the case of a frame-type cabinet 90, the rear cabinet post is used as a supporting member for the slide mount. The rear cabinet post must be in sufficient alignment with the front cabinet post so as to allow a plumb fit for the cabinet portion of the drawer slide 10. The slide mounts 98 are installed to the rear cabinet post in such horizontal orientation which is located by measurement. At this point, the drawer slide 10 of the present invention is separated into the cabinet portion 61 and the drawer portion 79, by depressing the stop lever 23. The stop lever 23, which is not a part of the present invention, allows the drawer channel 16 of the drawer slide assembly 10 to be extracted longitudinally from the cabinet portion 61. The cabinet members are installed utilizing the features described above, with the cabinet portion having an alignment allowing for substantially horizontal movement of the drawer from the closed to the open position, and vice versa.

Once the cabinet portion 61 of the slide 10 is installed and secured to the cabinet construction, the drawer channel 16 of the drawer slide 10 is fastened after locating it on the sidewall of the drawer box 74. Again, measurement of the placement may be required so as to orient the fit of the drawer 74 with the cabinet 90 as close as possible prior to any necessary adjustments.

After installation of the drawer portion 74, the inner ball retainer 20 is moved to the latched position in the center channel of the cabinet portion of the slide, as shown in FIG. 12. Similarly, the center channel 14 is pulled completely toward its forwardmost position as shown in FIG. 13. As indicated previously, the inner ball retainer 20 will be retained by the latch grip in the forwardmost position so as to conveniently keep alignment of the access ways in the appropriate position.

At this point, the drawer channel 16, having been affixed to the sidewalls 76 of the drawer box, are inserted into the receiving portion of the center channel stop 28 and the ball retainer 20, and the drawer 74 and drawer slide 10 are both moved to the completely closed position. By latch grips or fingers 62 extending slightly over the edge of the bearing retainer, the drawer channel 16 will be guided by fingers 62 over the inner ball retainer 20 to prevent the inner end of the drawer channel 16 from engaging the end of the inner ball retainer 20 so that the latter will not be axially shifted by the end of drawer channel 16 to cause difficulty of assembly. Rather, the inner end of the drawer channel 16 slides over the fingers 62, which also helps to retain the bearing retainer, and into engagement with the ball bearings themselves, for optimum inter engagement insertion. At this point, the installer may open and close the drawer while determining whether or not a proper fit has been achieved. Typically some adjustment is required owing to variations in the cabinet and drawer constructions; however, on infrequent occasions it is possible that the fit is satisfactory at this stage. In either event, the drawer need not be removed from the cabinet in order to finalize mounting by tightening down the screws affixing the drawer to the drawer channel or, in the alternative, for adjustments required to take place.

If it has been determined that a suitable fit has not been obtained, the drawer 74 and drawer slide assembly 10 are moved to the completely open position. At this point the retainer 20, center channel 14 and drawer channel 16 are all in such alignment to allow direct access to the screws mounted through the drawer channel. The screws may be loosened and the drawer can be adjusted within the slotted mounting holes 52, with the screws 82 thereafter being tightened somewhat to hold the drawer in place while the fit is checked again. The process is repeated until such time as the desired fit has been obtained and the drawer is then returned to the completely open position and the screws are finally tightened down. Completion of the installation in this fashion is expedited by usage of the access ways and alignments discussed herein. In the prior art, numerous trial and error adjustments were made before achieving a good fit, this having occurred more as the rule rather than the exception.

In the event the installation is in a frameless cabinet 110 such as that shown in FIG. 11, the installation process is quite similar and differs only in minor ways. Again the drawer slide is separated by depressing the stop lever 23 which disengages the drawer channel 16 from the channel 14. The drawer channel 16 is thereafter installed on the drawer 74, as was the case for the frame-type cabinet 90. The cabinet channel 12, is installed in a predrilled hole pattern within the frameless cabinet structure. The ball retainer 20 and center channel 14 are moved to the forward position. As was the case in the previous version, the inner ball retainer 20 is reversibly held in the latched position. The drawer 74 and the associated drawer channel 16 of the drawer slide 10 are inserted into the cabinet 110 and the drawer slide 10 and drawer 74 are moved to the completely closed position. Again the drawer is opened and closed while the installer checks for appropriate fit. If adjustment is needed, access is provided through the access ways of center channel 14 and inner ball retainer 20 directly to the mounting screws holding the drawer to the drawer portion of the slide. Once adjustment has been effected, the mounting screws 82 are tightened completely and the installation is finished.

It should be noted that any suitable mounting screws may be selected for use in installation of a drawer slide of the present invention. It is envisioned that pan head type and slot head screws may be used. Additionally, other methods of attachment may be feasible, and thus fall within the spirit and scope of the present application.

A drawer slide with access ways, having been described in the foregoing, is utilizable as an expeditious means to install a drawer in a cabinet. The typical drawer box 74 and cabinet 90, particularly those of wooden construction, have variations which necessitate post-installation adjustments. The usage of a precision drawer slide 10 and retainer assembly 20 with access ways and aligned mounting holes, provides for the first time an easy and expeditious means to achieve the adjustment both in the cabinet and, most importantly, with respect to the drawer fit in the cabinet structure.

As can be appreciated from FIGS. 7 and 8, the cabinet portion of the new drawer slide has been designed to allow for strategic alignment of the access ways and mounting holes. In particular, the cabinet portion has three elements which must be taken into account in order to achieve this particular simplicity, and these are the inner ball retainer 20, the center channel 14 and the cabinet channel 16 itself. The first consideration is the mounting of the cabinet portion 61 onto the cabinet structure 90. As indicated previously herein, the typical installation method is to utilize a three point mounting which comprises screwing the cabinet channel 12 to the cabinet structure 90. The mounting points are near the front of the cabinet channel, the middle of the cabinet channel, and the rear of the cabinet channel member, as shown in FIG. 11. In the prior art, this initial step was accomplished by moving the corresponding elements such as the center channel, or the inner ball retainer, back and forth until clearance was obtained for addressing a particular cabinet mounting hole with a screw. In the present invention, as can be seen in particular in FIGS. 7 and 8, the access ways found in the inner ball retainer 20 and the center channel 14 provide immediate and direct access to the mounting holes in the cabinet channel 12. Ideally, the cabinet channel 12 would be installed in the open position as shown in FIG. 7, which would reveal and three point mounting position of the cabinet channel to the cabinet structure. Mounting in this fashion would include positioning of the ball retainer 20 to its most forward position within the center channel. Not only does this align the inner ball retainer in a position where it does not interfere with access to the cabinet channel, it also prepares the access ways for adjustments to the drawer box when it is installed onto the drawer slide as a whole. It should be noted that the inner ball retainer 20 is retained in the forward position in the present invention by means of latch grips 62 (FIG. 5) found on the center stop. The latch grips provide a slight biased tension on the flange ends 64 of the inner ball retainer itself, thus reversibly gripping it and holding it in position.

In the alternative, the cabinet portion of the drawer slide may be installed where the elements are arrayed as indicated in FIG. 8. In this closed position version, the fourth mounting point is accessible through the access ways 68*a* and 68*b* (FIG. 7*b*) in both the inner ball retainer 20 and the center channel 14. Of chief importance, however, is the fact that the other three more conventional mounting points remain accessible through the access ways 60*a*–60*b*, no matter how the installer elects to proceed with the installation process. This is an important feature for the reason that installations may proceed on the basis of using fixtures or jigs (not shown) to hold the drawer slide components in place. If the fixturing of the cabinet portion 61 of the drawer slide 10 requires that the elements be held in the closed position, then the design as shown in FIG. 8 retains its versatility and function as providing direct access to the mounting holes of interest.

The next general concern in the installation process is installation of the drawer portion 79 onto the drawer box 74. Preferably, the drawer portion includes the drawer channel 74 which is provided with slotted mounting holes 52 which allow a degree of adjustment to occur in the vertical or horizontal direction. The screws may be tightened only partially and after installation has occurred into the cabinet, access to these screws through the access ways can provide a very quick and convenient means of facilitating the final adjustments.

As can be seen in FIG. 3 in particular, the drawer member mounting holes 52(*a*) through 52(*k*) are directly accessible through the access ways in the inner ball retainer 20 and the access ways in the center channel 14. This compatibility allows the installer to directly make adjustments from the side of the drawer in the installed position by penetrating the center channel, the inner ball retainer, and directly engaging the mounting screws 82 for the drawer channel 16. It is a unique characteristic of the present invention that the rearmost mounting points on the drawer channel 16 are accessible through the center channel and inner ball retainer access holes. A complex orientation of the access ways provides the necessary clearance for reaching the mounting holes. It is this particular feature that allows for quick adjustment of the drawer position in the installed position. Access to the remaining mounting holes is available as a result of the telescoping action which allows the drawer channel to extend beyond the center channel 16 and the inner ball retainer 20 contained therein. Thus, access to the mid to front portions of the drawer channel is free from any interferences in this fully extended position.

While the teachings of the present invention have been drawn to applications involving wood construction, this is by no means meant to be a limitation on usage. Thus, the drawer assembly may be used in metal or other types of construction. Typically, however, metal cabinet constructions are preformed and prefit such that adjustments of the drawer to the cabinet are not needed after installation. However, if such adjustments are necessary, usage of access ways to gain clearance to mounting holes and fasteners would be well within the level of those skilled in the art.

In the foregoing description, it will be readily perceived by those skilled in the art that modifications may be made without departing from the concepts disclosed herein. Such modifications are to be considered included in the following claims, unless these claims by their language expressly state otherwise.

The embodiments of the invention in which an exclusive property or privilege is claimed are defined as follows:

1. A drawer slide assembly for suspending a drawer in a cabinet, comprising:

a cabinet channel mountable to a cabinet;

a drawer channel mountable to a drawer, said drawer channel including at least two mounting holes in spaced relation;

a center channel interconnecting and telescopically engaged with said cabinet and drawer channels such that said drawer slide assembly is movable between a retracted closed position and an extended open position, said center channel including at least one access opening;

a bearing retainer assembly slidably engaged with said center channel and said drawer channel, said bearing retainer assembly including a body and bearings, and said bearing retainer assembly including at least one outer flange for holding said bearings, said body including an access opening having the capacity to be positioned in alignment with said at least one access opening in said center channel and a plurality of mounting holes in said drawer channel;

a holding member supported on one of said channels engagable with said retainer body for holding said retainer body when said drawer slide assembly is in said open position, said holding member including at least one projection which retainably engages said at least one outer flange when said drawer slide assembly is in said open position.

2. The drawer slide assembly as defined in claim 1, wherein said at least one projection temporarily deformable to engage said retainer and return to a previous position when disengaged from said retainer.

3. A drawer slide assembly for suspending a drawer in a cabinet, comprising:

a cabinet channel mountable to a cabinet;

a drawer channel mountable to a drawer, said drawer channel including at least two mounting holes in spaced relation; and a center channel interconnecting and telescopically engaged with said cabinet channel and said drawer channel by connectors, one of said connectors including a first bearing retainer assembly having access openings and said connectors including a second bearing retainer assembly having access openings, said drawer slide assembly being telescopically movable between a retracted closed position and an extended open position, and said center channel including at least one access opening which is alignable with at least one opening in said bearing retainer assemblies and different ones of said mounting holes by movable translation of said center channel with respect to said drawer channel;

an engagement member engagable with one of said retainer assemblies when said drawer slide assembly is in said extended open position to position said openings in said one retainer assembly, said engagement member including projections which latch said one of said retainer assemblies at a predetermined position when the drawer, channel is disassembled from said cabinet channel.

4. A furniture unit comprising:

a cabinet;

a drawer;

a drawer slide assembly including a first channel and a second channel, said first channel coupled to said drawer and said second channel attached to said cabinet, said second channel including enlarged mounting orifices and smaller mounting orifices; and fasteners for attaching said second channel to said cabinet, wherein said first channel includes access openings for simultaneously accessing at least one enlarged mounting orifice and at least one smaller mounting orifice to facilitate location and adjustment of the position of said drawer on said cabinet.

5. A drawer slide assembly for suspending a drawer in a cabinet comprising:

a plurality of channel members, one of said channel members being a drawer channel connectable to a drawer and another one of said channel members being a cabinet channel connectable to a cabinet, said channel members having inner and outer ends and assembled for telescopic movement between a retracted closed position and an extended open position;

bearings carried between two of said channel members;

a bearing retainer body positioning said bearings; and a retainer engagement member supported on one of said channel members for selectively engaging said bearing retainer body in said extended open position said retainer engagement member comprising at least one outwardly extending projection which engages said bearing retainer body in a biased gripping action that retains said bearing retainer body, whereby said retainer engagement member is engaged with said bearing retainer body to hold said bearing retainer body at a predetermined position when said drawer and cabinet channels are disassembled to facilitate reassembly of said drawer and cabinet channels.

6. The drawer slide assembly as defined in claim 5, wherein said body includes at least two flange ends and said engagement member includes two projections.

7. The drawer slide assembly as defined in claim 6, wherein the projections flexibly grip oppositely positioned flanges.

8. A drawer slide assembly for suspending a drawer slide within a cabinet, comprising:

a cabinet channel mountable to a cabinet, said cabinet channel including more than three mounting holes therethrough;

a drawer channel mountable to a drawer; and a center channel telescopically engaged with said cabinet and drawer channels by a connector such that said channels move between a retracted closed position and an extended open position, and wherein said center channel includes at least three access holes that are alignable with at least three of said mounting holes in said extended open position.

9. The drawer slide assembly as defined in claim 8, wherein said connector is a bearing retainer assembly.

10. A drawer slide assembly comprising:

a drawer portion having a drawer channel mountable to a drawer;

a cabinet portion having a cabinet channel mountable to a cabinet and a center channel slidingly supported on said cabinet channel, said drawer and cabinet portions assembleable to one another for sliding movement between a retracted closed position and an extended open position when assembled;

said cabinet channel including at least three screw mounting orifices; and said center channel including at least three access openings positioned such that in the retracted position, said at least three cabinet channel screw mounting orifices are accessible through said at least three access openings.

11. The drawer slide assembly as defined in claim 10, wherein said drawer channel includes screw mounting orifices and at least one of said center channel access openings is alignable with one of said mounting orifices in said drawer channel when the drawer and cabinet portions are assembled and the drawer slide assembly is in the extended open position.

12. The drawer slide assembly as defined in claim 11, wherein at least some of said access openings are holes through the center channel.

13. A drawer slide assembly having an inner end and an outer end, comprising:

a drawer channel mountable to a drawer;

a cabinet channel mountable to a cabinet;

a center channel positioned between said drawer and cabinet channels and telescopingly engaged therewith to enable the drawer slide assembly to be movable between a retracted closed position and an extended open position;

a bearing retainer positioned between said center channel and said drawer channel;

a center stop carried on said center channel and a collector carried on said center channel, said collector disposed on said center channel at a location to contact said retainer and position said retainer at a predetermined location on said center channel when the drawer slide assembly is fully closed, and said collector is spaced from said center stop a distance sufficient that said retainer does not contact said center channel stop when the drawer slide assembly is fully extended and said retainer has moved to an open position;

said center stop disposed to engage said beating retainer when said drawer channel is removed from said center channel, said center stop including two fingers which contact said retainer when said drawer channel is removed from said center channel.

14. A drawer slide assembly comprising:

a drawer channel mountable to a drawer;

a cabinet channel mountable to a cabinet;

a center channel positioned between said drawer and cabinet channels and telescopingly engaged therewith to enable the drawer slide assembly to be movable between a retracted closed position and an extended open position, said drawer channel selectively removable from said center channel;

a bearing retainer including bearings and a body positioned between said center channel and said drawer channel; and a center stop carried on said center channel, said center stop including a plurality of fingers which engage said bearing retainer when said drawer channel is removed from said center channel.

15. The drawer slide assembly as defined in claim 14, wherein said figures are integral with a body of said center stop and contact said bearing retainer body when said drawer channel is removed from the center channel.

16. A drawer slide assembly for suspending a drawer in a cabinet, comprising:

a cabinet channel mountable to a cabinet;

a drawer channel mountable to a drawer, said drawer channel including at least two mounting holes in spaced relation;

a center channel interconnecting and telescopically engaged with said cabinet channel and said drawer channel by connectors, one of said connectors including a bearing retainer assembly having access openings, said drawer slide assembly being telescopically movable between a retracted closed position and an extended open position, and said center channel including at least one access opening which is alignable with at least one opening in said bearing retainer assembly and different ones of said mounting holes by movable translation of said center channel with respect to said drawer channel;

an engagement member engagable with said retainer assembly when said drawer slide assembly is in said extended open position, said engagement member including projections which latch said retainer assembly at a predetermined position when the drawer channel is disassembled from said cabinet channel.

* * * * *

UNITED STATES PATENT AND TRADEMARK OFFICE

CERTIFICATE OF CORRECTION

PATENT NO. : 5,466,060
DATED : November 14, 1995
INVENTOR : Keith A. Hoffman

It is certified that error appears in the above-identified patent and that said Letters Patent is hereby corrected as shown below:

Column 4, line 35;

"mourning" should be –mounting–.

Column 4, line 37;

"mourning" should be –mounting–.

Column 5, line 25;

"from" should be –front–.

Column 5, line 29;

"from" should be –front–.

UNITED STATES PATENT AND TRADEMARK OFFICE

CERTIFICATE OF CORRECTION

PATENT NO. : 5,466,060
DATED : November 14, 1995
INVENTOR : Keith A. Hoffman

It is certified that error appears in the above-identified patent and that said Letters Patent is hereby corrected as shown below:

Column 9, line 45, claim 2;

After "projection" insert –is–.

Column 11, line 52, claim 13;

"beating retainer" should be –bearing retainer–.

Column 12, line 23, claim 15;

"figures" should be –fingers–.

Signed and Sealed this

Ninth Day of July, 1996

*Attest:*

Bruce Lehman

BRUCE LEHMAN

*Attesting Officer*

*Commissioner of Patents and Trademarks*